US009909402B2

(12) United States Patent
Armistead

(10) Patent No.: US 9,909,402 B2
(45) Date of Patent: Mar. 6, 2018

(54) SYSTEM, APPARATUS AND METHOD FOR PRODUCING A WELL

(71) Applicant: Chevron U.S.A. Inc., San Ramon, CA (US)

(72) Inventor: George T. Armistead, Katy, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 256 days.

(21) Appl. No.: 14/959,989

(22) Filed: Dec. 4, 2015

(65) Prior Publication Data

US 2016/0084052 A1 Mar. 24, 2016

Related U.S. Application Data

(63) Continuation-in-part of application No. 13/585,483, filed on Aug. 14, 2012.
(Continued)

(51) Int. Cl.
*E21B 43/24* (2006.01)
*E21B 43/12* (2006.01)
(Continued)

(52) U.S. Cl.
CPC ..... *E21B 43/24* (2013.01); *E21B 36/00* (2013.01); *E21B 36/005* (2013.01);
(Continued)

(58) Field of Classification Search
CPC ..... E21B 43/24; E21B 36/00; E21B 36/005; E21B 43/121; E21B 43/128; E21B 43/38;
(Continued)

(56) References Cited

U.S. PATENT DOCUMENTS 5,950,732 A 9/1999 Agee et al.
6,035,933 A 3/2000 Khalil et al.
(Continued)

FOREIGN PATENT DOCUMENTS

WO 2003/086976 10/2003

OTHER PUBLICATIONS

International Search Report, dated Jan. 30, 2013, during the prosecution of International Application No. PCT/US2012/050728.
(Continued)

*Primary Examiner* — Wei Wang

(57) ABSTRACT

A system is provided that is capable of providing heat across a produced interval during oil and gas production to minimize or reduce undesirable formation of gas hydrates in the wellbore. In one embodiment, the configuration provides a means to recycle heat generated by an electrical submersible pump. Heat from the pump may be applied downhole. One configuration is capable of providing for downhole separation of gas from produced fluids to reduce or eliminate gas transit through the pump. A heating element also may apply heat to produced fluids. An orifice may apply heat to produced fluids. The wellbore being drilled to a depth having a subterranean formation temperature that is high enough to elevate a temperature of the production fluids to a predetermined temperature such that the temperature of the production fluids is elevated to the predetermined temperature by at least the depth of the wellbore.

18 Claims, 1 Drawing Sheet

Related U.S. Application Data

(60) Provisional application No. 61/524,596, filed on Aug. 17, 2011.

(51) Int. Cl.
*E21B 43/38* (2006.01)
*E21B 36/00* (2006.01)

(52) U.S. Cl.
CPC ..... *E21B 43/121* (2013.01); *E21B 43/128* (2013.01); *E21B 43/38* (2013.01)

(58) Field of Classification Search
CPC .. E21B 43/2401; E21B 43/385; E21B 36/006; E21B 36/04; E21B 43/04; E21B 43/281; E21B 43/285; E21B 43/12
See application file for complete search history.

(56) References Cited

U.S. PATENT DOCUMENTS

| | | | |
|---|---|---|---|
| 6,702,028 | B1 | 3/2004 | Heggholmen |
| 2006/0032637 | A1 | 2/2006 | Ayoub et al. |
| 2009/0078406 | A1 | 3/2009 | Talley et al. |
| 2009/0178803 | A1 | 7/2009 | Neuroth et al. |
| 2010/0147514 | A1 | 6/2010 | Swaringin |
| 2010/0258306 | A1 | 10/2010 | Camilleri et al. |
| 2013/0068454 | A1 | 3/2013 | Armistead |

OTHER PUBLICATIONS

Written Opinion of the International Searching Authority, dated Jan. 30, 2013, during the prosecution of International Application No. PCT/US2012/050728.

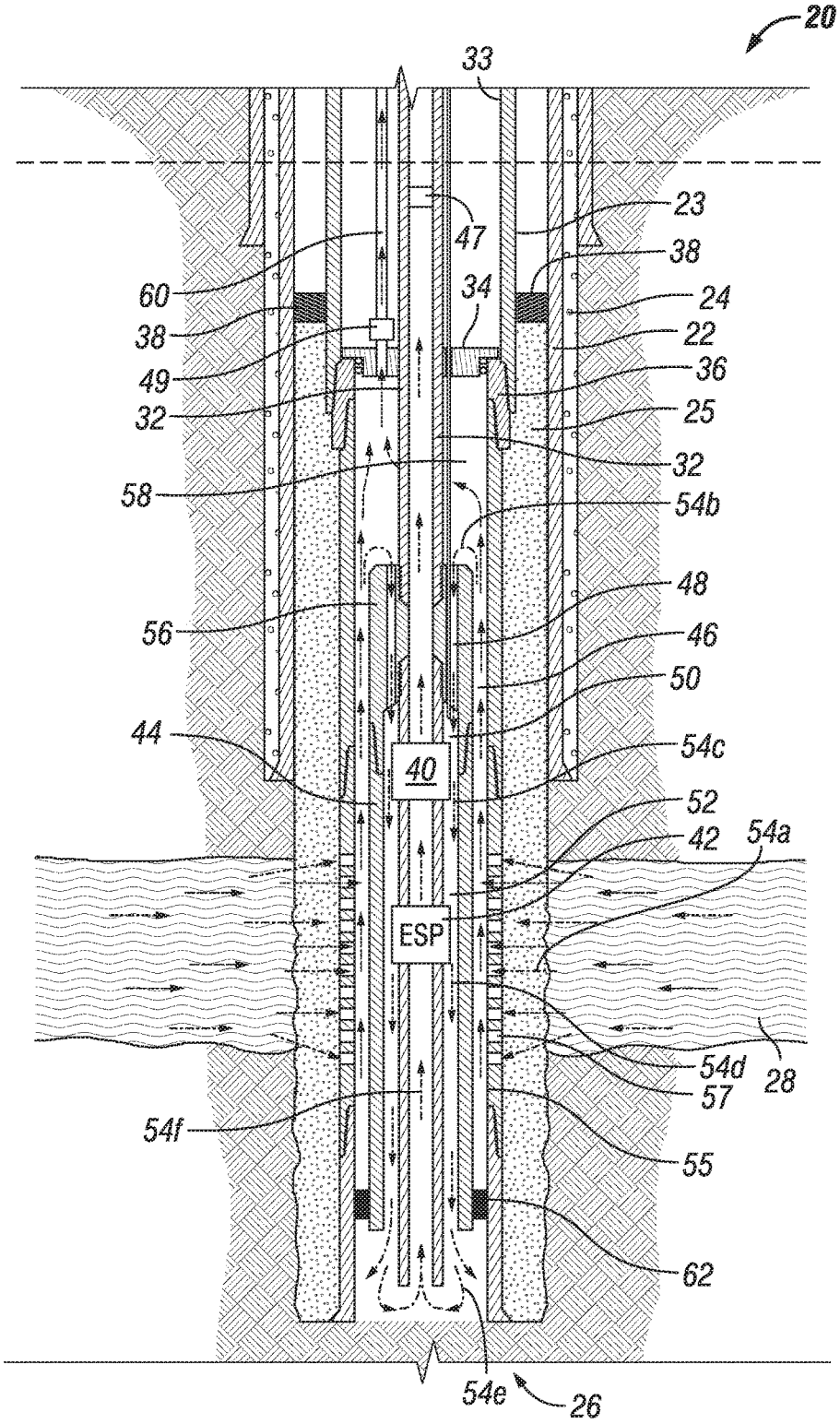
20
33
23
47
38
60
34
24
38
22
49
36
32
25
32
58
54b
48
56
46
50
44
54c
40
52
42
54a
ESP
54d
28
57
54f
55
62
54e
26

SYSTEM, APPARATUS AND METHOD FOR PRODUCING A WELL

CROSS REFERENCE TO RELATED INVENTIONS

This application claims priority as a continuation-in-part application from U.S. application Ser. No. 13/585,483, filed on Aug. 14, 2012, which claims priority from U.S. Provisional Patent Application No. 61/524,596, filed on Aug. 17, 2011, the disclosures of both of which are also hereby incorporated by reference in their entireties.

FIELD OF THE INVENTION

The invention is directed to a system, apparatus and method for producing fluids and gas from a wellbore.

BACKGROUND OF THE INVENTION

A problem in the production of oil and gas from subsea wellbores is the undesirable formation of gas hydrates. A gas hydrate is a crystalline solid consisting of molecules of gas, usually methane, surrounded by a "cage" of water molecules. Gas hydrates have the visual appearance of ice. Methane hydrate is stable in ocean floor sediments at water depths of greater than about 300 meters. Certain temperature and pressure conditions encourage the formation of gas hydrates.

Gas hydrates pose a problem for the oil and gas industry as more deepwater gas enters the supply stream. Gas hydrates may form inside pipelines or in wellbores, slowing or completely blocking flow of hydrocarbons. Hydrate formation is a serious problem for producers moving gas from offshore wells to onshore processing facilities. Clearing plugged lines is expensive and time-consuming, and may take as long as twenty days. It has been estimated that controlling and preventing gas hydrate formation costs the industry hundreds of millions of dollars annually. It is very important to make changes or adjustments in wellbores to reduce the likelihood of gas hydrate formation.

In the production of oil and gas, it is sometimes necessary to employ downhole electrical submersible pumps to assist in moving oil from the formation to the surface in the wellbore. Submersible pumps are used in such operations to provide a relatively efficient form of "artificial lift". By decreasing the pressure at the bottom of the well, more oil can be produced from the well when compared with natural production. Such pumps typically are electrically powered and may be referred to as Electrical Submersible Pumps ("ESP").

ESP systems may be subject to undesirable cavitation if excess gas is present in the flow stream being pumped. Shock waves caused by cavitation in pumps may damage moving parts within the pump. It is desirable to avoid entrained gas in production fluids that are to be pumped by a downhole ESP to avoid damage to pumps.

SUMMARY OF THE INVENTION

A system, apparatus and method is provided for producing oil and gas from a wellbore within a subterranean formation. The system comprises a wellbore lined with a casing, the wellbore having an upper end and a lower end, the lower end of the wellbore being adjacent the subterranean formation. The casing is tubular in shape with an interior cavity. Casing is installed in sections when the well is constructed, with each successive section of casing installed in the drilled well being slightly smaller in diameter than the prior section of casing. Production tubing is positioned within the interior cavity of the casing. A pump may be connected to the production tubing, the pump being adapted for lifting hydrocarbons within the production tubing.

An isolation sleeve may be positioned circumferentially outside of the production tubing and within the interior cavity of the casing. An inner space may be located between the isolation sleeve and the production tubing. An outer space also may be positioned between the isolation sleeve and the casing. The isolation sleeve may be configured to facilitate the upward movement, within the outer space, of production fluids and gas towards the upper end of the wellbore. Gas is separated from the production fluids, and the isolation sleeve may be configured to facilitate the downward movement, within the inner space, of production fluids toward the lower end of the wellbore.

A pump may be adapted for transmission of heat to the production fluids in the inner space, thereby elevating the temperature of the production fluids. The system may be configured for transferring heat carried by the production fluids to the lower end of the wellbore to reduce the formation of gas hydrates in the wellbore. In general, adding heat to the lower end of the wellbore assists in inhibiting undesirable gas hydrate formation.

In one specific aspect of the invention the system also comprises a heating element positioned to contact production fluids in the inner space. Further, a ported bushing sub may be employed to receive production fluids and gas from the outer space and facilitate the movement of the production fluids to the inner space. The ported bushing sub may be positioned adjacent a gas collection space. Production fluids and gas from the inner space may proceed through the ported bushing sub for separation, so that gas is accumulated in the gas collection space while production fluids are provided to the inner space for transport further down into the wellbore.

In yet another embodiment of the invention, an annular seal locator sub may be positioned above the gas collection space. The annular seal locator sub may be configured for releasing gas from the gas collection space towards the upper end of the wellbore. A safety valve may be positioned upon the annular seal locator sub for controlling gas release from the gas collection space. The ported bushing sub may be adapted for sealed engagement with a polished bore receptacle (a "PBR").

In one embodiment of the invention, at least one heating element is provided upon or adjacent the production tubing. The method may include the additional step of transferring heat from the heating element to the production fluids and applying such heat towards the lower end of the wellbore. Further, production fluids may be pumped through the production tubing towards the upper end of the wellbore.

In one embodiment of the invention, a system for producing oil and gas from a wellbore penetrating a subterranean formation includes (a) the wellbore lined with a casing, the wellbore having an upper end and a lower end, and the lower end of the wellbore being adjacent the subterranean formation. The wellbore is configured to receive production fluids and gas from a production zone of the subterranean formation. The casing is tubular in shape with an interior cavity. The system includes (b) production tubing positioned within the interior cavity of the casing and (c) a pump connected to the production tubing, the pump being adapted for lifting hydrocarbons within the production tubing. The system includes (d) an isolation sleeve positioned circumferentially outside of the production tubing and within the interior cavity of the casing, (e) an inner space between the isolation sleeve and the production tubing, and (f) an outer space between the isolation sleeve and the casing. (g) The isolation sleeve being configured to facilitate the upward movement, within the outer space, of the production fluids and gas towards the upper end of the wellbore. (h) The isolation sleeve being configured to facilitate the downward movement, within the inner space, of the production fluids toward the lower end of the wellbore. In the system, (i) the wellbore is being drilled to a depth having a subterranean formation temperature that is high enough to elevate a temperature of the production fluids to a predetermined temperature such that the temperature of the production fluids is elevated to the predetermined temperature by at least the depth of the wellbore. In the system, (j) the system is being configured for transferring heat carried by the production fluids to the upper end of the wellbore to reduce viscosity of the production fluids, increase production rate, reduce formation of gas hydrates, reduce formation of paraffins, or any combination thereof in the wellbore.

In one embodiment of the invention, a method of producing oil and gas from a wellbore is provided. The wellbore having a casing penetrating a subterranean formation, the wellbore having an upper end and a lower end, the wellbore configured to receive production fluids and gas from a production zone of the subterranean formation, and the wellbore being drilled to a depth having a subterranean formation temperature that is high enough to elevate a temperature of the production fluids to a predetermined temperature. The method includes (a) providing production tubing within an interior cavity of the casing, the production tubing being connected to a pump, the pump being adapted for lifting hydrocarbons within the production tubing; (b) providing an isolation sleeve positioned circumferentially outside of the production tubing and within the interior cavity the casing, there being an inner space between the isolation sleeve and the production tubing, further providing an outer space between the isolation sleeve and the casing; and (c) moving production fluids and gas within the outer space towards the upper end of the wellbore. The method further includes (d) separating the production fluids from the gas, (e) moving production fluids downward within the inner space adjacent the pump; (f) transferring heat from the depth of the wellbore to the production fluids; (g) elevating the temperature of the production fluids to the predetermined temperature by at least the depth of the wellbore; and (h) transferring heat carried by the production fluids towards the upper end of the wellbore to reduce viscosity of the production fluids, increase production rate, reduce formation of gas hydrates, reduce formation of paraffins, or any combination thereof in the wellbore Jj In one embodiment of the invention, a system for isolating gas in a wellbore is provided. The wellbore having a casing with an interior cavity formed by an interior surface, the wellbore having an upper end and a lower end, the wellbore configured to receive production fluids and gas from a production zone of a subterranean formation, and the wellbore being drilled to a depth having a subterranean formation temperature that is high enough to elevate a temperature of the production fluids to a predetermined temperature. The system includes (a) a polished bore receptacle forming a seal with the interior surface of the casing; and (b) an annular seal locator sub mated with the polished bore receptacle, the annular seal locator sub being configured to form a collection space below the annular seal locator sub to collect gas within the casing of the wellbore, the annular seal locator sub further comprising at least one penetration adapted for a safety valve. In the system, (c) the wellbore being drilled to a depth having a subterranean formation temperature that is high enough to elevate a temperature of the production fluids to a predetermined temperature such that the temperature of the production fluids is elevated to the predetermined temperature by at least the depth of the wellbore. (d) The system being configured for transferring heat carried by the production fluids to the upper end of the wellbore to reduce viscosity of the production fluids, increase production rate, reduce formation of gas hydrates, reduce formation of paraffins, or any combination thereof in the wellbore.

BRIEF DESCRIPTION OF THE DRAWINGS

FIG. 1 shows a cross sectional view of one embodiment of the system of the invention.

DETAILED DESCRIPTION OF THE INVENTION

A system, apparatus and method is provided that is capable of providing heat across a produced interval during oil and gas production that may serve to minimize or reduce undesirable formation of gas hydrates in the wellbore. In one embodiment the configuration provides a means to recycle and conserve heat generated by an electrical submersible pump ("ESP"). Also, it may be possible in some applications to provide additional heat downhole by the use of one or more heating elements to apply heat to produced fluids that are circulated downhole, thereby minimizing the undesirable formation of gas hydrates within or adjacent to the wellbore interface. An isolation sleeve may be employed that extends across the completion interval and is sealed near the bottom in a seal receptacle, causing the flow stream from the wellbore to flow up the outside of the isolation sleeve. The fluids and gas may be separated, as further described herein. Also, such heat could assist in producing heavy oil in some applications, by making the heavy oil less viscous and more capable of flow.

In one embodiment, the configuration is capable of providing for downhole separation of the gas to reduce or eliminate gas from being produced through an ESP. Producing gas through an ESP is undesirable, as it may damage the pump by way of cavitation or "gas lock". The system in one embodiment may provide for the safe containment and selective release of gas within the wellbore by the utilization of an annular safety valve.

Turning to FIG. 1, an example of the invention is shown. A subterranean formation 28 contains a wellbore upper end 20 and wellbore lower end 26 (seen at the upper and lower portions of FIG. 1). A casing 22 extends into the wellbore and is cemented in place with cement 24. Production tubing 32 is shown in the central portion of FIG. 1, extending through the annular seal locator sub 34 and the ported bushing sub 56. The annular seal locator sub 34 mates with polished bore receptacle 36 in a gas tight seal. A cement plug 38 seals against the inside surface of the casing 22 circumferentially around the periphery of casing 22. Further, inner casing 23, is cemented in place by cement 25. The inner casing 23 mates with polished bore receptacle 36 to form a seal.

An optional heating element 40 may be provided as shown in association with the production tubing 32 and in position to contact production fluids to transfer heat to production fluids. Electrical submersible pump (ESP) 42 also is provided in association with production tubing 32 and is provided to provide pumping pressure to assist in moving production fluids upwards within production tubing 32. An isolation sleeve 44 is provided, and it is associated with the ported bushing sub 56. The isolation sleeve 44 separates and defined an outer space 46 from inner space 48. The outer space receives commingled production fluid comprising gas and liquids, while the inner space contains primarily only liquid production fluids. The separation of the gas from the production fluids will occur in the gas collection space 58, as further discussed herein. Gas may be released through gas release line 60 upon opening of valve 49.

The flow of production fluids begins in subterranean formation 28 and proceeds through perforations 57 in lower casing joint 55. The pathway of production fluids proceeds along arrow 54*a* within outer space 46 towards the wellbore upper end 20. At gas collection space 58, the gas portion of the production fluids is collected, while the liquid portion of production fluids proceeds through the ports (not shown) of the ported bushing sub 56 downwards towards the wellbore lower end 26 along arrow 54*b* into inner space 48. At point 50, the liquid portion of the production fluids within inner space 48 is in position to collect heat generated by the optional heating element 40 and proceed further downwards within the inner space 48 to point 52. At point 52, the liquid portion of the production fluids receive heat from the ESP and continue to travel downwards towards arrow 54*c* and then to arrow 54*d*. The heated liquid portion of the production fluids transmit heat to the wellbore lower end 26 to assist in preventing the formation of gas hydrates in the wellbore lower end 26. Fluids travel along the path of arrow 54*e*, where they change direction and then proceed upwards along arrow 54*f* into the production tubing 32. Production tubing 32 contains release valve 47. Fluids are produced from the wellbore upper end 20 through production tubing 32.

In the practice of the invention, many different equipment sizes may be employed. However, one embodiment of the invention, as shown, employs a polished bore receptacle 36 having a 15 inch internal diameter in the bottom of an 18⅝ inch casing 33. Further, the production tubing 32 may be 4½ inch in diameter in the embodiment shown in FIG. 1.

The ported bushing sub 56 may be a triple bushing sub, also known as a triple connection bushing. Such a bushing comprises three connections—a washpipe connection and two drillpipe connections. The ported bushing sub 56 may be run in connection with a backoff or packer retrieving assembly. The triple connection bushing sub may be employed for a bottom hole assembly requiring an inside and outside assembly. The outside diameter is built per specifications of the washpipe connection and the internal diameter is determined by the specifications of the smaller drillpipe connection.

One example of a suitable isolation sleeve 44 is of a size 11¾ inch×8⅝ inch. A gravel pack with perforations 57 is commonly used in such an application. A sump packer 62 is shown near the lower portion of FIG. 1.

Provided herein are various embodiments consistent with the inventive principles. In one embodiment, a system for producing oil and gas from a wellbore penetrating a subterranean formation comprises: (a) the wellbore lined with a casing, the wellbore having an upper end and a lower end, the lower end of the wellbore being adjacent the subterranean formation, wherein the wellbore is configured to receive production fluids and gas from a production zone of the subterranean formation, further wherein the casing is tubular in shape with an interior cavity; (b) production tubing positioned within the interior cavity of the casing; (c) a pump connected to the production tubing, the pump being adapted for lifting hydrocarbons within the production tubing; (d) an isolation sleeve positioned circumferentially outside of the production tubing and within the interior cavity of the casing, (e) an inner space between the isolation sleeve and the production tubing; (f) an outer space between the isolation sleeve and the casing; (g) the isolation sleeve being configured to facilitate the upward movement, within the outer space, of the production fluids and gas towards the upper end of the wellbore; and (h) the isolation sleeve being configured to facilitate the downward movement, within the inner space, of the production fluids toward the lower end of the wellbore, and (i) wherein the wellbore being drilled to a depth having a subterranean formation temperature that is high enough to elevate a temperature of the production fluids to a predetermined temperature such that the temperature of the production fluids is elevated to the predetermined temperature by at least the depth of the wellbore, and (j) wherein the system being configured for transferring heat carried by the production fluids to the upper end of the wellbore to reduce viscosity of the production fluids, increase production rate, reduce formation of gas hydrates, reduce formation of paraffins, or any combination thereof in the wellbore.

In one embodiment, a method of producing oil and gas from a wellbore, the wellbore having a casing penetrating a subterranean formation, the wellbore having an upper end and a lower end, the wellbore configured to receive production fluids and gas from a production zone of the subterranean formation, and the wellbore being drilled to a depth having a subterranean formation temperature that is high enough to elevate a temperature of the production fluids to a predetermined temperature, the method comprises: (a) providing production tubing within an interior cavity of the casing, the production tubing being connected to a pump, the pump being adapted for lifting hydrocarbons within the production tubing; (b) providing an isolation sleeve positioned circumferentially outside of the production tubing and within the interior cavity the casing, there being an inner space between the isolation sleeve and the production tubing, further providing an outer space between the isolation sleeve and the casing; (c) moving production fluids and gas within the outer space towards the upper end of the wellbore; (d) separating the production fluids from the gas; (e) moving production fluids downward within the inner space adjacent the pump; (f) transferring heat from the depth of the wellbore to the production fluids; (g) elevating the temperature of the production fluids to the predetermined temperature by at least the depth of the wellbore; and (h) transferring heat carried by the production fluids towards the upper end of the wellbore to reduce viscosity of the production fluids, increase production rate, reduce formation of gas hydrates, reduce formation of paraffins, or any combination thereof in the wellbore.

In one embodiment, a system for isolating gas in a wellbore, the wellbore having a casing with an interior cavity formed by an interior surface, the wellbore having an upper end and a lower end, the wellbore configured to receive production fluids and gas from a production zone of a subterranean formation, and the wellbore being drilled to a depth having a subterranean formation temperature that is high enough to elevate a temperature of the production fluids to a predetermined temperature, the system comprises: (a) a polished bore receptacle forming a seal with the interior surface of the casing; and (b) an annular seal locator sub mated with the polished bore receptacle, the annular seal locator sub being configured to form a collection space below the annular seal locator sub to collect gas within the casing of the wellbore, the annular seal locator sub further comprising at least one penetration adapted for a safety valve, and (c) wherein the wellbore being drilled to a depth having a subterranean formation temperature that is high enough to elevate a temperature of the production fluids to a predetermined temperature such that the temperature of the production fluids is elevated to the predetermined temperature by at least the depth of the wellbore, and (d) wherein the system being configured for transferring heat carried by the production fluids to the upper end of the wellbore to reduce viscosity of the production fluids, increase production rate, reduce formation of gas hydrates, reduce formation of paraffins, or any combination thereof in the wellbore.

There may be several benefits to the wellbore configurations provided herein. Each of these does not apply to all wells but each could apply to a well completion scenario:

(i) Having the downhole capability to separate gas from the liquids—An ESP downhole pump, which is a form of a centrifugal pump, may cavitate and may be very inefficient with the presence of gas. Thus, it may be advantageous to have downhole separation of the liquids (e.g., the production fluids) from the gas and only have liquids go through the ESP downhole pump.

(ii) Heating up the temperature of the interval being produced from in order to enhance the production performance from the productive interval—Many shallow production zones around the world at shallow depths are considered "heavy oil" with inherent high viscosities. Thus, it may be advantageous to have the capability to heat up the wellbore above the ambient or natural temperature of the production zone to lower the viscosity of the productive fluids and enhance the ability of the production fluids to flow through a porous media, thereby increasing the production performance.

(iii) Heating up the temperature of the wellbore near the mud line and aid in the elimination of gas hydrates or formation of paraffins. Gas hydrates and paraffins are solids formed from the PVT effects of liquids or reduction in pressure on various compositions of produced natural gases. If the formation of gas hydrates or paraffins is not mitigated, then the surface equipment can become completely plugged due to the formed solids. Thus, it may be advantageous to mitigate these solids by heating up the wellbore in the region where hydrates or paraffins are likely to form above the PVT temperature in which they will form solids, thereby preventing or reducing them from forming.

The configuration of the wellbore herein provides for the downhole separation of the liquids and gas to aid in the pump performance by eliminating or reducing cavitation as described in (i) above. In addition, the configuration of the wellbore enables several items to heat up the production fluids to enhance production performance as described by (ii) above and/or to mitigate hydrates and paraffins as described by (iii) above. Moreover, by having the outer and inner spaces, there is no limitation to the wellbore depth by which this configuration can be applied. For example, a production zone may be at a fairly shallow depth below the mud line, but the actual wellbore may be drilled to a substantial depth deeper (e.g., tens of feet to hundreds of feet to even thousands of feet deeper) with much higher temperature than the temperature of the production zone and the depth of the wellbore alone may be utilized to elevate the temperature of the production fluids. Alternatively, the actual wellbore may be drilled to a depth such that a combination of the depth of the wellbore and at least one other item may be utilized to elevate the temperature of the production fluids. Thus, the system may be configured for transferring heat carried by the production fluids (e.g., to the upper end of the wellbore) to reduce viscosity of the production fluids, increase production rate, reduce formation of gas hydrates, reduce formation of paraffins, or any combination thereof in the wellbore.

There are may be several items in this configuration to add heat to the production fluids. For example, the temperature of the production fluids may be elevated to the predetermined temperature by the depth of the wellbore, a pump (e.g., at least one downhole electric pump), at least one heating element, at least one orifice (e.g., at least one downhole orifice), or any combination thereof. Of note, the configuration may have a pump (e.g., a rod pump on the surface) that is not utilized to elevate the temperature of the production fluids to get to the predetermined temperature. A downhole orifice may cause a temperature increase due to the frictional pressure loss through the orifice. The depth of the wellbore item, as provided herein, uses the temperature of the subterranean formation as a heat sink to raise the flow stream temperature. Other items may also be utilized to elevate the temperature of the productions fluids to the predetermined temperature and this is not meant to be an exhaustive list of items. In some embodiments, the predetermined temperature is higher than a production zone temperature of the production zone. The production zone temperature and other temperatures mentioned herein may be determined via sensors, gauges, or other methodologies known to those of ordinary skill in the art.

To avoid confusion, various options are contemplated. In some embodiments, the depth of the wellbore alone may be utilized. For example, the wellbore may be drilled to a depth having a subterranean formation temperature that is high enough to elevate a temperature of the production fluids to a predetermined temperature such that the temperature of the production fluids is elevated to the predetermined temperature by at least the depth of the wellbore.

In some embodiments, a combination of the depth of the wellbore and a pump may be utilized. For example, a pump may be adapted for transmission of heat to the production fluids in the inner space such that the temperature of the production fluids is elevated to the predetermined temperature by the depth of the wellbore, the pump, or any combination thereof.

In some embodiments, a combination of the depth of the wellbore and at least one heating element may be utilized. Alternatively, a combination of the depth of the wellbore, a pump, and at least one heating element may be utilized. For example, at least one heating element positioned to contact the production fluids in the inner space such that the temperature of the production fluids is elevated to the predetermined temperature by the depth of the wellbore, the pump, the at least one heating element, or any combination thereof.

In some embodiments, a combination of the depth of the wellbore and at least one orifice may be utilized. Alternatively, a combination of the depth of the wellbore, at least one orifice, and a pump may be utilized. Alternatively, a combination of the depth of the wellbore, at least one orifice, and at least one heating element may be utilized. Alternatively, a combination of the depth of the wellbore, at least one orifice, a pump, and at least one heating element may be utilized. For example, at least one orifice positioned to contact the production fluids in the inner space such that the temperature of the production fluids is elevated to the predetermined temperature by the depth of the wellbore, the pump, the at least one heating element, the at least one orifice, or any combination thereof.

In short, as provided herein, the wellbore may be drilled to a depth having a subterranean formation temperature that is high enough to elevate a temperature of the production fluids to a predetermined temperature such that the temperature of the production fluids is elevated to the predetermined temperature by at least the depth of the wellbore. The predetermined temperature may be based on the production zone temperature and/or the subterranean formation temperature. The production zone temperature, the subterranean formation temperature, and/or the temperature of the production fluids may be factored into determining what depth to drill the wellbore and what items (e.g., pump, at least one heating element, and/or at least one orifice) to include in the wellbore to get to the predetermined temperature.

In one example, at a depth of 1000' below mud line, the temperature may be 50° F. in the productive interval (e.g., production zone temperature of 50° F.). The predetermined temperature to enhance production may be 80° F. Multiple items may be utilized in order to raise the temperature of the wellbore to this predetermined temperature. An ESP pump may raise the temperature by 10° F. A heating element may raise the temperature by 10° F. The well may be drilled to a depth in which the subterranean formation temperature is high enough and will add an additional 15° F. increase in temperature due to the heat sink effect from the earth to the production fluids as they are circulated through the higher temperature environment. In addition, the flow can be forced, if necessary, through small designed orifices that restrict flow and cause an increase in temperature due to the frictional pressure loss through the orifice. The combination of all of these items may raise the temperature of the production fluids to 85° F. above the predetermined temperature of 80° F. to obtain the desired performance effects. In addition to the flow configuration, the sizes of the outer and inner spaces along with the thermodynamic heat transfer properties of the materials may be selected to augment the desired heat transfer.

The invention is shown by example in the illustrated embodiments. However, it is recognized that other embodiments of the invention having a different configuration but achieving the same or similar result are within the scope and spirit of the claimed invention. For example, provided herein are embodiments for utilizing heat from far below (e.g., substantial distance below) the production zone to heat up the production fluid

The invention claimed is:

1. A system for producing oil and gas from a wellbore penetrating a subterranean formation, the system comprising:

(a) the wellbore lined with a casing, the wellbore having an upper end and a lower end, the lower end of the wellbore being adjacent the subterranean formation, wherein the wellbore is configured to receive production fluids and gas from a production zone of the subterranean formation, further wherein the casing is tubular in shape with an interior cavity;

(b) a production tubing positioned within the interior cavity of the casing;

(c) a pump connected to the production tubing, the pump being adapted for lifting hydrocarbons within the production tubing;

(d) an isolation sleeve positioned circumferentially outside of the production tubing and within the interior cavity of the casing, (e) an inner space between the isolation sleeve and the production tubing;

(f) an outer space between the isolation sleeve and the casing;

(g) the isolation sleeve being configured to facilitate the upward movement, within the outer space, of the production fluids and the gas towards the upper end of the wellbore; and (h) the isolation sleeve being configured to facilitate the downward movement, within the inner space, of the production fluids toward the lower end of the wellbore, and (i) wherein the wellbore being drilled to a depth having a subterranean formation temperature that is high enough to elevate a temperature of the production fluids to a predetermined temperature such that the temperature of the production fluids is elevated to the predetermined temperature by at least the depth of the wellbore, and (j) wherein the system being configured for transferring heat carried by the production fluids to the upper end of the wellbore to reduce viscosity of the production fluids, increase production rate, reduce formation of gas hydrates, reduce formation of paraffins, or any combination thereof in the wellbore.

2. The system of claim 1, wherein the pump is being adapted for transmission of heat to the production fluids in the inner space such that the temperature of the production fluids is elevated to the predetermined temperature by the depth of the wellbore, the pump, or any combination thereof.

3. The system of claim 2, the system further comprising at least one heating element positioned to contact the production fluids in the inner space such that the temperature of the production fluids is elevated to the predetermined temperature by the depth of the wellbore, the pump, the at least one heating element, or any combination thereof.

4. The system of claim 1, wherein the predetermined temperature is higher than a production zone temperature of the production zone.

5. The system of claim 1, further comprising a ported bushing sub, wherein the ported bushing sub is configured to receive the production fluids and the gas from the outer space and facilitate the movement of the production fluids to the inner space.

6. The system of claim 5, wherein the ported bushing sub is positioned adjacent a gas collection space, wherein the production fluids and the gas from the outer space proceed above the ported bushing sub for separation such that the gas is accumulated in the gas collection space while the production fluids are provided to the inner space through the ported bushing sub for transport downhole.

7. The system of claim 6, wherein an annular seal locator sub is positioned above the gas collection space, the annular seal locator sub being configured for releasing the gas from the gas collection space towards the upper end of the wellbore.

8. The system of claim 7, wherein a safety valve is positioned upon the annular seal locator sub for controlling release of the gas from the gas collection space.

9. The system of claim 7, wherein the annular seal locator sub is adapted for sealed engagement with a polished bore receptacle.

10. A method of producing oil and gas from a wellbore, the wellbore having a casing penetrating a subterranean formation, the wellbore having an upper end and a lower end, the wellbore configured to receive production fluids and gas from a production zone of the subterranean formation, and the wellbore being drilled to a depth having a subterranean formation temperature that is high enough to elevate a temperature of the production fluids to a predetermined temperature, the method comprising:

(a) providing a production tubing within an interior cavity of the casing, the production tubing being connected to a pump, the pump being adapted for lifting hydrocarbons within the production tubing;

(b) providing an isolation sleeve positioned circumferentially outside of the production tubing and within the interior cavity the casing, there being an inner space between the isolation sleeve and the production tubing, further providing an outer space between the isolation sleeve and the casing;

(c) moving the production fluids and the gas within the outer space towards the upper end of the wellbore;

(d) separating the production fluids from the gas;

(e) moving the production fluids downward within the inner space adjacent the pump;

(f) transferring heat from the depth of the wellbore to the production fluids;

(g) elevating the temperature of the production fluids to the predetermined temperature by at least the depth of the wellbore; and (h) transferring heat carried by the production fluids towards the upper end of the wellbore to reduce viscosity of the production fluids, increase production rate, reduce formation of gas hydrates, reduce formation of paraffins, or any combination thereof in the wellbore.

11. The method of claim 10, further comprising transferring heat from the pump to the production fluids in the inner space such that the temperature of the production fluids is elevated to the predetermined temperature by the depth of the wellbore, the pump, or any combination thereof.

12. The method of claim 11, further comprising providing at least one heating element to contact the production fluids in the inner space such that the temperature of the production fluids is elevated to the predetermined temperature by the depth of the wellbore, the pump, the at least one heating element, or any combination thereof.

13. The method of claim 10, wherein the predetermined temperature is higher than a production zone temperature of the production zone.

14. A system for isolating gas in a wellbore, the wellbore having a casing with an interior cavity formed by an interior surface, the wellbore having an upper end and a lower end, the wellbore configured to receive production fluids and gas from a production zone of a subterranean formation, the system comprising:

(a) a polished bore receptacle forming a seal with the interior surface of the casing; and (b) an annular seal locator sub mated with the polished bore receptacle, the annular seal locator sub being configured to form a collection space below the annular seal locator sub to collect the gas within the casing of the wellbore, the annular seal locator sub further comprising at least one penetration adapted for a safety valve, and (c) wherein the wellbore being drilled to a depth having a subterranean formation temperature that is high enough to elevate a temperature of the production fluids to a predetermined temperature such that the temperature of the production fluids is elevated to the predetermined temperature by at least the depth of the wellbore, and (d) wherein the system being configured for transferring heat carried by the production fluids to the upper end of the wellbore to reduce viscosity of the production fluids, increase production rate, reduce formation of gas hydrates, reduce formation of paraffins, or any combination thereof in the wellbore.

15. The system of claim 14, further comprising:

a production tubing positioned within the casing and extend through the annular seal locator sub;

an isolation sleeve positioned circumferentially outside of the production tubing and within the casing;

an inner space between the isolation sleeve and the production tubing; and an outer space between the isolation sleeve and the casing, wherein the isolation sleeve is configured to facilitate the upward movement, within the outer space, of the production fluids and the gas towards the upper end of the wellbore, and wherein the isolation sleeve is configured to facilitate the downward movement, within the inner space, of the production fluids toward the lower end of the wellbore.

16. The system of claim 15, further comprising a pump connected to the production tubing, the pump being positioned downhole from the annular seal locator sub, the pump further being adapted for lifting hydrocarbons within the production tubing, wherein the pump is being adapted for transmission of heat to the production fluids in the inner space such that the temperature of the production fluids is elevated to the predetermined temperature by the depth of the wellbore, the pump, or any combination thereof.

17. The system of claim 16, further comprising at least one heating element positioned to contact the production fluids in the inner space such that the temperature of the production fluids is elevated to the predetermined temperature by the depth of the wellbore, the pump, the at least one heating element, or any combination thereof.

18. The system of claim 14, wherein the predetermined temperature is higher than a production zone temperature of the production zone.

* * * * *